United States Patent [19]

Christen et al.

[11] 4,316,671

[45] Feb. 23, 1982

[54] APPARATUS FOR CONTINUOUS MIXING OF SOLIDS AND LIQUIDS

[75] Inventors: Werner Christen; Helmut Müller, both of Mannheim, Fed. Rep. of Germany

[73] Assignee: Draiswerke GmbH, Mannheim, Fed. Rep. of Germany

[21] Appl. No.: 154,098

[22] Filed: May 28, 1980

[30] Foreign Application Priority Data

Jun. 9, 1979 [DE] Fed. Rep. of Germany ..... 2923502

[51] Int. Cl.[3] ..... B01F 7/04; B01F 15/02

[52] U.S. Cl. ..... 366/192; 366/195; 222/290; 222/313

[58] Field of Search ..... 366/192, 193, 195, 42, 366/43, 77; 222/491, 290, 313

[56] References Cited

U.S. PATENT DOCUMENTS 3,231,146 1/1966 Troy ..... 222/491 X 3,734,471 5/1973 Engels ..... 366/192 X

FOREIGN PATENT DOCUMENTS 2219352 11/1973 Fed. Rep. of Germany .

2717896 10/1978 Fed. Rep. of Germany .

*Primary Examiner*—Philip R. Coe

*Attorney, Agent, or Firm*—Browdy and Neimark

[57] ABSTRACT

An apparatus for mixing solid particles and a liquid, especially wood chips and glue. A motor-driven stirrer in a cylinderical trough continuously mixes the materials which enter at one end of the trough and are discharged at the other end. The outlet of the trough has a pivotable throttle with a counterweight which controls the degree of opening of the throttle. An electrical signal related to the load on the stirrer motor is the control signal for a control loop whose final control element displaces the counterweight to maintain the electrical load of the drive motor approximately constant.

5 Claims, 5 Drawing Figures

APPARATUS FOR CONTINUOUS MIXING OF SOLIDS AND LIQUIDS

FIELD OF THE INVENTION

The invention relates to apparatus for the continuous mixing and wetting of solids, especially wood chips and fibers, with liquids, especially liquid glue.

BACKGROUND OF THE INVENTION

Known mixing apparatus of the kind to which this invention relates is described, for example, in U.S. Pat. No. 3,734,471 and includes a mixing trough or drum having suitable inlet and outlet funnels for admitting and discharging, respectively, the materials to be mixed and wetted. The materials are agitated by a coaxial motor-driven mixing shaft or stirrer equipped with radial arms that cause a generally axial advance of the material through the trough in the form of a ring which retains contact with the wall of the trough.

Located in the outlet funnel is a pivoted and counterweighted throttle valve. The degree of opening of the throttle flap depends on the pressure exerted by mixing stock on the pivoted throttle flap. The distance of the counterweight from the pivotal axis of the throttle flap is adjustable, making possible an initial adaptation of the machine to certain anticipated operating conditions, e.g. to the kind of chips to be used and the like.

Another embodiment of the mixing apparatus, described in U.S. Pat. No. 3,734,471 provides for control of the throttle flap by an electromagnet, actuated in dependence on the power consumption of the drive motor for the mixing shaft, so that the opening/closure position of the throttle, which is constant for a given motor load, can be varied as the current consumption fluctuates.

The known apparatus is not capable of reliably maintaining the motor load, i.e. the electrical power consumption, constant as the operating conditions of the mixer change.

OBJECT OF THE INVENTION

It is, accordingly, an object of the present invention to overcome the deficiencies of a mixer of the above-described kind in such a manner that the load imposed on the drive motor can be maintained constant. This object is attained, according to the invention, by providing a mixing apparatus with a mixing trough having an inlet and an outlet and an outlet throttle valve. According to the invention, the counterweight for the pivotable throttle can be moved by a motor to adjust the valve to different operating conditions of the mixer. Thus, the possibility of opening the throttle in correspondence to the pressure of the stock in the mixing container is augmented by varying the closure force for each position of the throttle flap. In this way, an operator might displace the counterweight toward the pivotal axis of the throttle flap when he observes an increase of the current consumption of the drive motor, so that the closure pressure of the throttle flap as a whole decreases, or vice versa. In a fully automatic configuration, the motor serving to position the counterweight then becomes the positioning, or final control element of control circuitry to maintain constant the current, power consumption of the drive motor of the mixing shaft. In this way, it is possible to eliminate shutdowns due to motor overload. Furthermore, the entire quality of glue deposition upon the chips can be improved by the precise regulation now possible, because even short-term fluctuations of the operating conditions, for example, fluctuations in the density of the chip mixture or the like, can be compensated.

In a particularly advantageous embodiment of the invention, the counterweight is the final control element of a control loop which holds the electrical load of the drive motor of the mixing stirrer constant.

An advantageous feature of the invention provides that the counterweight is constituted by the housing of the motor which moves the counterweight.

Further advantages and features of the invention will be more apparent from the following detailed description of sample embodiments taken in conjunction with the drawing.

THE DRAWING

DESCRIPTION OF THE PREFERRED EMBODIMENTS

Figure 1:
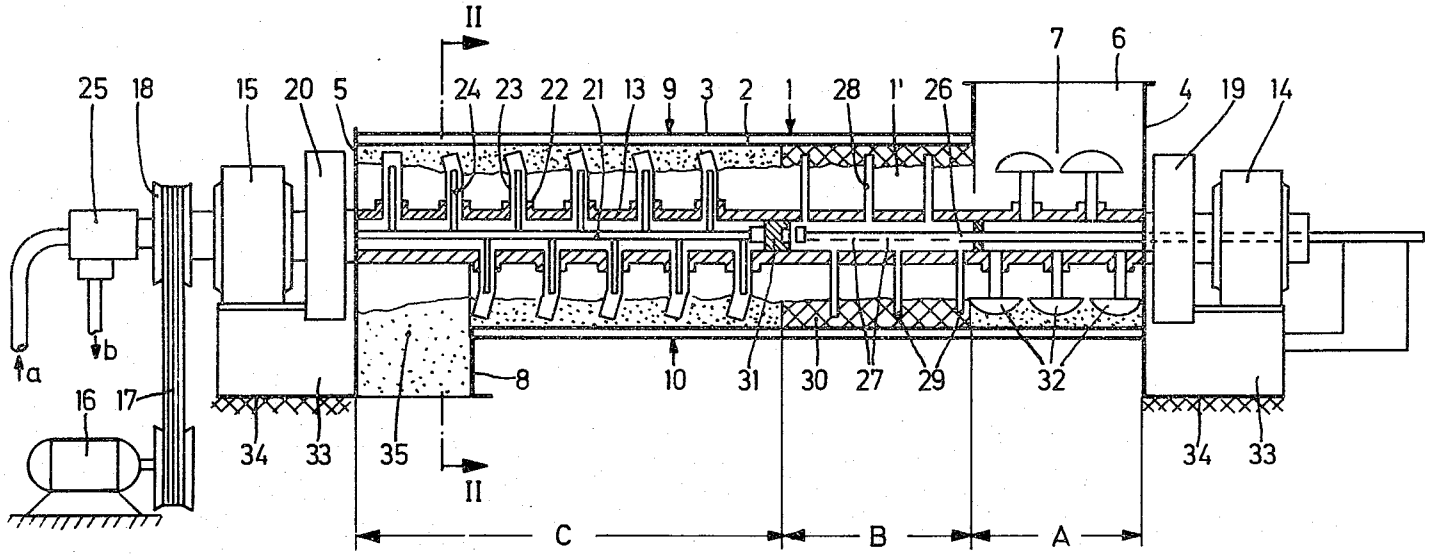
FIG. 1 shows a mixer according to the invention in axial section.

The mixer illustrated in the drawing has a cylindrical mixing container 1 consisting of an inner trough 2 forming its inner wall of a cooling jacket 3 surrounding the inner trough. The mixing container 1 is closed at its ends by bulkheads 4, 5. A material inlet funnel 6 is provided at one end—the right end in FIG. 1—of the mixing container 1. The funnel 6 with its mixing stock inlet opening 7 tangentially enters the inner chamber 1' of the mixing container 1 enclosed by the inner trough 2 and the bulkheads 4 and 5. A likewise tangential material outlet funnel 8 is located at the other end—the left end in FIG. 1. The mixing container 1 is divided into halves in the horizontal plane, the upper half 9 and the lower half 10 of the mixing container 1 being mutually pivotable at one longitudinal side by hinges 11 and are held together at the opposite longitudinal side by releasable fasteners 12. A coaxial mixer shaft 13 is disposed within the mixing container 1.

The shaft 13 is supported by bearings 14, 15 and is rotated by a motor 16 with the aid of V-belt 17 and a V-belt pully 18 nonrotatably attached to the shaft 13 which also carries balancing discs 19, 20. A cooling water supply tube 21 is located within the mixer shaft 13 and rotates with the shaft 13. Threaded sleeves 22 are attached to the mixer shaft 13 and hollow mixing tools 23 can be screwed into the sleeves 22. A cooling water supply tube 24 branches off into each hollow mixing tool 23 from the cooling water supply tube 21, so that the cooling water flows through the cooling water supply tube 21, continuing through the cooling water tubes 24, through the inner chamber of each of the mixing tools 23, and into the annular chamber between the cooling water supply tube 21 and the interior of the mixer shaft 13. The cooling water reaches the mixer shaft 13 via a cooling water connection 25—provided at the left in FIG. 1—in which the cooling water supply is designated "a" and the cooling water discharge is designated "b".

A glue supply tube 26 extends into the hollow mixer shaft 13 at the other end of the mixer 13—at the right in FIG. 1. The tube 26 does not rotate with the shaft 13. Glue flows from the glue supply tube 26 through inlet openings 27 into the interior of the hollow mixer shaft 13, and is flung outwardly by glue sling tubes 28. The tubes 28 have outlet openings 29 which dip into the ring of material 30 that has built up on the inner wall of the mixer container 1 due to the centrifugal force which results when the shaft speed exceeds a certain critical value. A separator 31 is disposed in the hollow mixer shaft 13 between the mutually neighboring ends of the cooling water supply tube 21 and the glue supply tube 26.

The region of the container 1, over which the mixing stock inlet funnel 6 with the opening 7 extends in the longitudinal direction of the container 1, forms an entry zone A for the material. The material to be mixed, e.g. wood chips, is strongly accelerated radially within this entry zone A by the shovel-like feed tools 32 and forms the above-mentioned material ring 30. The longitudinal region of the mixing container 1 adjoining the entry zone A forms a glue admission zone B containing the glue-dispensing tubes 28 attached to the hollow mixer shaft 13. The next adjoining region containing the cooled mixing tools 23 disposed on the mixer shaft 13 is a post-mixing zone C. The mixing container 1 is supported by the bearings 14, 15 on a machine understructure 33 resting on the floor 34.

The introduction of glue through the hollow mixer shaft, is sometimes referred to as internal glue application. It is also possible to use external glue application through glue admission tubes which penetrate the cooling jacket 3 and the inner trough 2 in the same mixer container section B; these tubes and their outlets likewise terminate in the material 30. Such a configuration is described, for example, in the W. German laid-open application No. 2219 352.

Figure 2:
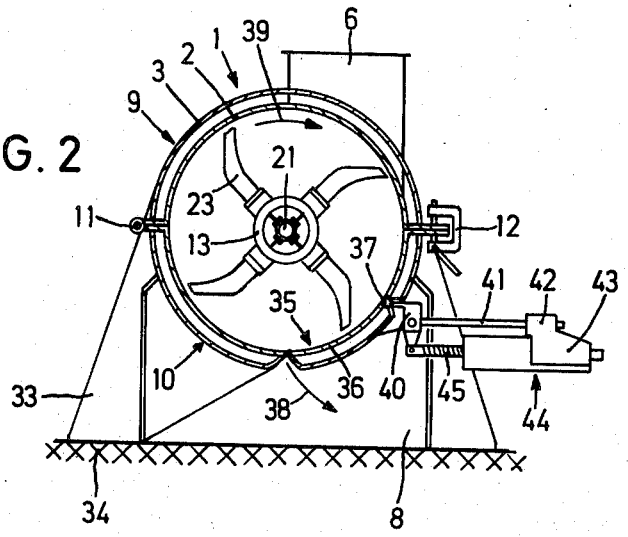
FIG. 2 is a section through the mixer along the section line II—II in FIG. 1.

An outlet opening 35 enters the outlet funnel 8 from the inner chamber 1' of the mixing container 1. This outlet opening 35 is closable in per se known manner by means of a throttle flap 36 fitted to the curvature of the inner trough 2 in the region of the outlet opening 35. The throttle flap 36 is pivoted at its upper and axially parallel edge by means of a joint 37 on the container 1, and can be pivoted downwardly and sideways to the right in FIG. 2 from the closed position shown in FIG. 2 in direction of the arrow 38. The outlet opening 35 is thus opened more or less depending on the prevailing pressure, and the rotating mixing tools 23 fling the material out through the variably opened outlet opening 35 into the outlet funnel 8.

A bracket 40 is attached to the outside of the throttle flap 36, and a guide rod 41 is rigidly affixed to the bracket 40 and extends outwardly approximately horizontally when the throttle flap 36 is closed. The stator housing 43 of a commercially available motor 44 is displaceably supported on the guide rod 41 by means of a guide bushing 42. The spindle 45 of the motor 44 is freely pivotable on the bracket 40, so that the guide rod 41 and the spindle 45 are mutually parallel. When the spindle motor 44 is actuated, its stator housing 43 is displaced axially on the guide rod 41 because the spindle 45 is attached to the bracket 40. This displacement changes the lever arm of the housing 43 of the stator motor 44 relative to the pivotal axis of the throttle flap 36 formed by the joint 37. It is possible to provide a double-acting hydraulic cylinder 46 instead of the motor 44; the piston rod 47 of such a hydraulic cylinder would be pivotably attached to the bracket 40 while the cylinder 48 is displaced on the guide rod 41 by a guide sleeve 42. The two pressure fluid inlet and outlet lines 49, 50 are only suggested in FIG. 3.

The control apparatus for this outlet throttle includes a current transformer 52 that produces a voltage which is proportional to the current flowing through the motor 16 and is inserted in the circuit 51 of the motor 16. The proportional voltage is rectified in a bridge rectifier 53. The DC voltage signal is then transmitted to a controller 54, where it is converted to a corresponding current in a resistor 55. This current is a direct current proportional to the current consumption of the motor. A potentiometer 56 serving as the demand value or reference value source is connected in parallel with the resistor 55. The output of the potentiometer 56 is connected to the output of the resistor 55, and the current coming from the demand value source and from the resistor 55 are added together at a junction point 57. A negative current is always supplied by the demand value source, whereas a positive current is being supplied by the resistor 55. An operational amplifier 58 follows the junction point 57, and applies a corresponding signal to a power amplifier 59 following the controller 54, according to whether a positive or a negative current difference is brought to the operational amplifier from the junction point 57. The spindle motor 44 is then energized by the power amplifier 59, displacing the stator housing 43 of the motor 44 along the guide rod 41 until such time as the current consumption of the motor 16 once again agrees with the demand (reference) value programmed by the potentiometer 56.

Figure 3:
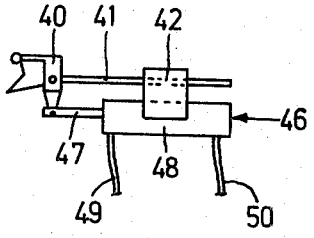
FIG. 3 is a partial section of FIG. 2 showing a variant of the counterweight.
Figure 4:
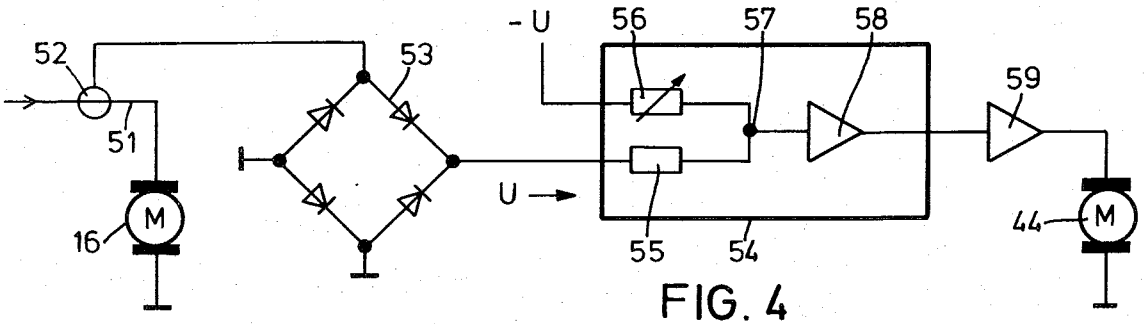
FIG. 4 shows a control circuit for the exemplary embodiment according to FIG. 2.
Figure 5:
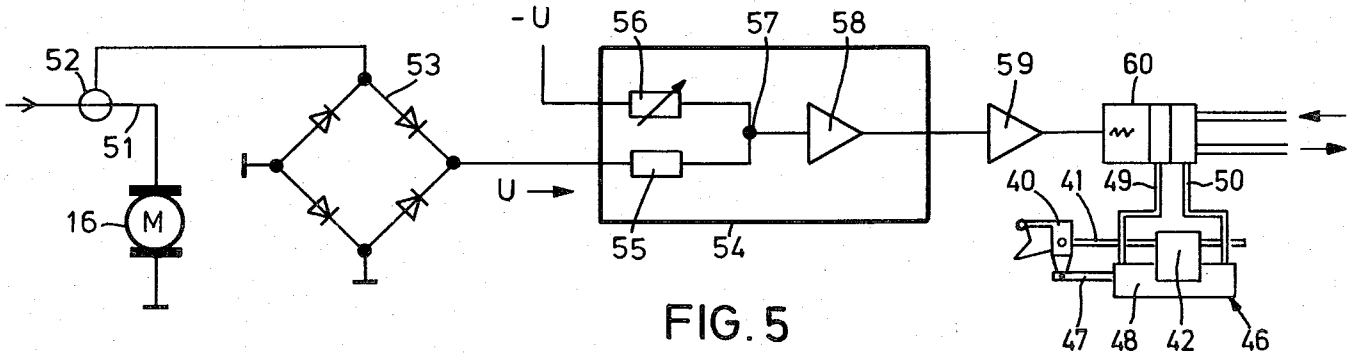
FIG. 5 shows a control circuit for the exemplary embodiment according to FIG. 3.

In hydraulic embodiments illustrated in FIGS. 3 and 5, a magnetic valve is actuated by the power amplifier 59. The magnetic valve switches the hydraulic supply between the fluid lines 49 and 50, one of these lines serving as a return line. In all other respects the remaining circuit is the same as already described.

It would also be possible to provide a counterweight that could be displaced on a guide rod by a motor coupled to the counterweight but otherwise stationary and attached to the throttle flap 36. In such an arrangement, it would be particularly appropriate to dispose the motor axially parallel with the joints 37, so that a bevel gear would suitably be provided between the motor and the counterweight.

The foregoing description relates to merely preferred exemplary embodiments of the invention. Other embodiments, variants and suitable changes may be made by those skilled in the art without departing from the spirit and scope of the invention.

What is claimed is:

1. An apparatus for the continuous mixing of solids with liquids preferably for the application of glue to chips, fibers or powered materials, comprising:

a cylindrical mixing container, material feed means at one end of said container and material outlet means at the other end of said mixing container;

means for admitting glue into said mixing container;

at least one mixing shaft mounted coaxically within said mixing container, said shaft being provided with mixing tools for axially propelling material through said container in the form of a ring of material;

a drive motor for driving said shaft;

a throttle valve in said material outlet means, said valve being provided with a positionable counterweight and operatively associated therewith;

means for adjusting the position of said counterweight; and said means for adjusting the position of said counterweight is a motor means (44) and said counterweight is formed by a housing (43,48) of said motor means (44).

2. An apparatus according to claim 1, wherein said counterweight comprises a positioning element of a control circuit for maintaining current or power consumption of said drive motor constant.

3. An apparatus according to claim 1, wherein said housing (43, 48) of said motor means is displaceably supported on a guide rod (41) fixedly attached to said throttle valve (36).

4. An apparatus according to claim 1, wherein said motor means comprises a spindle motor (44) which serves as said counterweight, a spindle (45) of said motor means (44) being attached to said throttle valve (36).

5. An apparatus according to claim 1, wherein a hydraulic cylinder (46) serves as said counterweight, a piston rod (47) of said cylinder (46) being attached to said throttle valve (36).

* * * * *